US011502448B2

(12) United States Patent
Watanabe

(10) Patent No.: US 11,502,448 B2
(45) Date of Patent: Nov. 15, 2022

(54) SPRING-LOADED CONNECTOR

(71) Applicant: YOKOWO CO., LTD., Tokyo (JP)

(72) Inventor: Yasushi Watanabe, Tomioka (JP)

(73) Assignee: YOKOWO CO., LTD., Tokyo (JP)

( * ) Notice: Subject to any disclaimer, the term of this patent is extended or adjusted under 35 U.S.C. 154(b) by 0 days.

(21) Appl. No.: 17/282,417

(22) PCT Filed: Sep. 24, 2019

(86) PCT No.: PCT/JP2019/037248
§ 371 (c)(1),
(2) Date: Apr. 2, 2021

(87) PCT Pub. No.: WO2020/071171
PCT Pub. Date: Apr. 9, 2020

(65) Prior Publication Data

US 2021/0384667 A1 Dec. 9, 2021

(30) Foreign Application Priority Data

Oct. 3, 2018 (JP) ..... JP2018-188275

(51) Int. Cl.
*H01R 13/52* (2006.01)
*H01R 13/24* (2006.01)

(52) U.S. Cl.
CPC ..... *H01R 13/521* (2013.01); *H01R 13/2421* (2013.01); *H01R 13/5202* (2013.01); *H01R 13/5213* (2013.01); *H01R 2201/16* (2013.01)

(58) Field of Classification Search
CPC ..... H01R 13/521; H01R 13/2421; H01R 13/5202; H01R 13/5213; H01R 2201/16
See application file for complete search history.

(56) References Cited

U.S. PATENT DOCUMENTS

2014/0377986 A1* 12/2014 Endo ..... H01R 4/48 439/519
2019/0067859 A1* 2/2019 Sugiura ..... H01R 13/2421
2020/0099163 A1* 3/2020 Tziviskos ..... H01F 7/02

FOREIGN PATENT DOCUMENTS

JP 56-105272 U 8/1981
JP 58-198875 A 11/1983
(Continued)

OTHER PUBLICATIONS

International Search Report and Written Opinion dated Dec. 24, 2019, received for PCT Application PCT/JP2019/037248, Filed on Sep. 24, 2019, 16 pages including English Translation.
(Continued)

*Primary Examiner* — Tho D Ta
(74) *Attorney, Agent, or Firm* — Xsensus LLP

(57) ABSTRACT

A spring-loaded connector (2) includes a waterproof elastic member (50). The waterproof elastic member (50) includes cylindrical parts (51) corresponding to respective contact units (10). When the cylindrical part (51) is sandwiched between a first pin (11) and an intermediate member (13) of the corresponding contact unit (10), the waterproof elastic member (50) seals between the first pin (11) and the intermediate member (13) in a watertight manner while allowing the contact unit (10) to penetrate. The waterproof elastic member (50) includes, between the cylindrical parts (51) that are adjacent to each other, a water-shielding structure (52) for preventing the first pins (11) of the contact units (10) corresponding to the adjacent cylindrical parts from being electrically connected due to presence of water between the first pins (11).

19 Claims, 11 Drawing Sheets

(56) References Cited

FOREIGN PATENT DOCUMENTS

| | | | | |
|---|---|---|---|---|
| JP | 2009-59586 | A | 3/2009 | |
| JP | 2017-174497 | A | 9/2017 | |
| WO | WO-2017159155 | A1 * | 9/2017 | ..... H01R 11/01 |

OTHER PUBLICATIONS

Japanese Office Action dated Sep. 13, 2022, in corresponding Japanese Patent Application No. 2018-188275.

* cited by examiner

SPRING-LOADED CONNECTOR

CROSS-REFERENCE TO RELATED APPLICATIONS

The present application is based on PCT filing PCT/JP2019/037248, filed Sep. 24, 2019, which claims priority to JP 2018-188275, filed Oct. 3, 2018, the entire contents of each are incorporated herein by reference.

TECHNICAL FIELD

The present invention relates to a spring-loaded connector.

BACKGROUND ART

A spring-loaded connector is a component that is used to electrically connect a first electronic device as one connection object (for example, a mobile communication device such as a smartphone or a mobile terminal for business use) and a second electronic device as the other connection object (for example, a charging cradle for the mobile communication device).

The spring-loaded connector holds a conductive, extendable contact unit having a pin shape in such a way that both ends of the contact unit are exposed. The spring-loaded connector is used in a state where a first pin that is one end portion of the contact unit is open to be connected to the first electronic device, and a second pin that is the other end portion of the contact unit is connected to a circuit of the second electronic device. General consumers see the spring-loaded connecter while the spring-loaded connector is embedded in the second electronic device.

The first electronic device is provided with a concave-convex structure for contacting the spring-loaded connector. When the first electronic device is abutted against the spring-loaded connector by the spring-loaded connector being inserted into the concave-convex structure, the first pin of the contact unit is pressed against an electrode disposed in the concave-convex structure and electrical continuity is established. The first electronic device and the second electronic device are thereby electrically connected. A user of the first electronic device may electrically connect the first electronic device to the second electronic device simply by abutting the first electronic device against the spring-loaded connector, so that the spring-loaded connector is now used in various devices from the standpoint of increasing convenience.

From another standpoint regarding convenience, the spring-loaded connector is desired to be waterproof, and manufacturers are making various refinements to meet such a demand.

For example, Patent Literature 1 discloses a structure according to which a waterproof elastic member is disposed between a first pin and an intermediate member at the time of assembling a contact unit to thereby seal between the first pin and the intermediate member in a watertight manner. Additionally, the intermediate member here is a member that is interposed between the first pin and a second pin to hold a spring.

PRIOR ART DOCUMENTS

Patent Literature

Patent Literature 1: JP A 2017-174497

SUMMARY OF INVENTION

Problems to be Solved by the Invention

One demand regarding the spring-loaded connector is to reduce its size. As a method of reducing the size, there is a method of narrowing arrangement intervals of contact units than those in related arts. However, when the arrangement intervals of the contact units are narrowed, the problem is that the contact units tend to be shorted due to presence of entering water. In the present specification, a term "water" is simply used to facilitate understanding, but liquids containing water and having similar conductivity as water are also included in the meaning of "water". This is because such liquids may be treated as equivalent of "water" in terms of properties.

An object of the invention is to provide a technology related to a spring-loaded connector for which both waterproofness and reduced size are achieved.

Solution to the Problems

A first aspect of the invention is a spring-loaded connector including:

contact units each including a first pin for contacting a first connection target, a second pin for contacting a second connection target, and an intermediate member for biasing the first pin and the second pin in directions away from each other;

a case including a cover including a through hole where a tip of the first pin is exposed, and a housing including a through hole where a tip of the second pin is exposed, the case being for supporting the contact units; and a waterproof elastic member including cylindrical parts corresponding to the contact units, respectively, the waterproof elastic member being disposed between the cover and the housing, a cylindrical part among the cylindrical parts sealing between the first pin and the intermediate member of a contact unit corresponding to the cylindrical part, among the contact units, in a watertight manner by being interposed between an inner side of the first pin and an outer side of the intermediate member, where the waterproof elastic member includes, between the cylindrical parts that are adjacent to each other, a water-shielding structure for preventing the first pins of the contact units corresponding to the cylindrical parts that are adjacent to each other from being electrically connected due to presence of water between the first pins.

The spring-loaded connector may be such that a length of the water-shielding structure in an intersecting direction is equal to or greater than an outer dimension of the cylindrical parts in the intersecting direction, the intersecting direction intersecting an arrangement direction of the cylindrical parts that are adjacent to each other.

A second aspect of the invention is a spring-loaded connector including:

contact units each including a first pin for contacting a first connection target, a second pin for contacting a second connection target, and an intermediate member for biasing the first pin and the second pin in directions away from each other;

a case including a cover including a through hole where a tip of the first pin is exposed, and a housing including a through hole where a tip of the second pin is exposed, the case being for supporting the contact units; and a waterproof elastic member including cylindrical parts corresponding to the contact units, respectively, the waterproof elastic member being disposed between the cover and the housing, a cylindrical part among the cylindrical parts sealing between the first pin and the intermediate member of a contact unit corresponding to the cylindrical part, among the contact units, in a watertight manner by being interposed between an inner side of the first pin and an outer side of the intermediate member, where the waterproof elastic member includes, between the cylindrical parts that are adjacent to each other, a water-shielding structure, a length of which in an intersecting direction being equal to or greater than an outer dimension of the cylindrical parts in the intersecting direction, the intersecting direction intersecting an arrangement direction of the cylindrical parts that are adjacent to each other.

The spring-loaded connector may be such that the water-shielding structure includes a protrusion.

The spring-loaded connector may be such that an upper end of the protrusion contacts an inner side of the cover in a state where the first pin is not in contact with the first connection target.

The spring-loaded connector may be such that the water-shielding structure includes a groove.

The spring-loaded connector may be such that the case supports the contact units in such a way that the contact units penetrate an inner space defined between the cover and the housing, and the waterproof elastic member separates the inner space into a first section on a side of the first pin and a second section on a side of the second pin by being disposed between the cover and the housing.

The spring-loaded connector may be such that the cover includes a communication hole through which outside and the first section communicate.

The spring-loaded connector may be such that the waterproof elastic member is elastically deformed when the first pin is abutted against the first connection target, and a section volume of the first section is greater in a connection state where the first pin is abutted against the first connection target than in a non-contact state where the first pin is not in contact with the first connection target.

The spring-loaded connector may be such that the waterproof elastic member is elastically deformed when the first pin is abutted against the first connection target, a section volume of the first section is greater in a connection state where the first pin is abutted against the first connection target than in a non-contact state where the first pin is not in contact with the first connection target, and the communication hole is a passage that is used when water entering the first section is to be discharged to the outside at a time of state transition from the connection state to the non-contact state.

The spring-loaded connector may be such that the waterproof elastic member includes the cylindrical parts each having a shape protruding toward the through hole of the cover, a skirt part sandwiched between the cover and the housing, and a sloping part between the cylindrical parts and the skirt part, the entering water flows down the sloping part to reach the skirt part, and the communication hole is formed at a position facing the sloping part.

The spring-loaded connector may be such that air of the outside flows in through the communication hole when the connection state is reached, and the air that flowed in is discharged through the communication hole at a time of state transition to the non-contact state.

The spring-loaded connector may be such that the communication hole is formed at a position at which a lower end of the communication hole is close to an upper surface of the skirt part.

A third aspect of the invention is a spring-loaded connector including:

a contact unit including a first pin for contacting a first connection target, a second pin for contacting a second connection target, and an intermediate member for biasing the first pin and the second pin in directions away from each other;

a case including a cover including a through hole where a tip of the first pin is exposed, and a housing including a through hole where a tip of the second pin is exposed, the case being for supporting the contact unit; and a waterproof elastic member including a cylindrical part corresponding to the contact unit, the waterproof elastic member being disposed between the cover and the housing, the cylindrical part sealing between the first pin and the intermediate member of the contact unit corresponding to the cylindrical part in a watertight manner by being interposed between an inner side of the first pin and an outer side of the intermediate member, where the waterproof elastic member includes the cylindrical part having a shape protruding toward the through hole of the cover, a skirt part sandwiched between the cover and the housing, and a sloping part between the cylindrical part and the skirt part, and the cover includes a communication hole formed at a position facing the sloping part.

The spring-loaded connector may be such that the case supports the contact unit in such a way that the contact unit penetrates an inner space defined between the cover and the housing, the waterproof elastic member separates the inner space into a first section on a side of the first pin and a second section on a side of the second pin by being disposed between the cover and the housing, and the communication hole allows outside and the first section to communicate.

The spring-loaded connector may be such that the waterproof elastic member is elastically deformed when the first pin is abutted against the first connection target, a section volume of the first section is greater in a connection state where the first pin is abutted against the first connection target than in a non-contact state where the first pin is not in contact with the first connection target, and the communication hole is a passage that is used when water entering the first section is to be discharged to the outside at a time of state transition from the connection state to the non-contact state.

The spring-loaded connector may be such that air of the outside flows in through the communication hole when the connection state is reached, and the air that flowed in is discharged through the communication hole at a time of state transition to the non-contact state.

The spring-loaded connector may be such that the communication hole is formed at a position at which a lower end of the communication hole is close to an upper surface of the skirt part.

Advantageous Effects of Invention

According to the aspects of the invention, even if water enters the case along the first pin or through the through hole, the water may be prevented by the water-shielding structure from remaining between the contact units that are adjacent to each other. A spring-loaded connector that achieves both waterproofness and reduced size may be realized.

DESCRIPTION OF EMBODIMENTS

Figure 1:
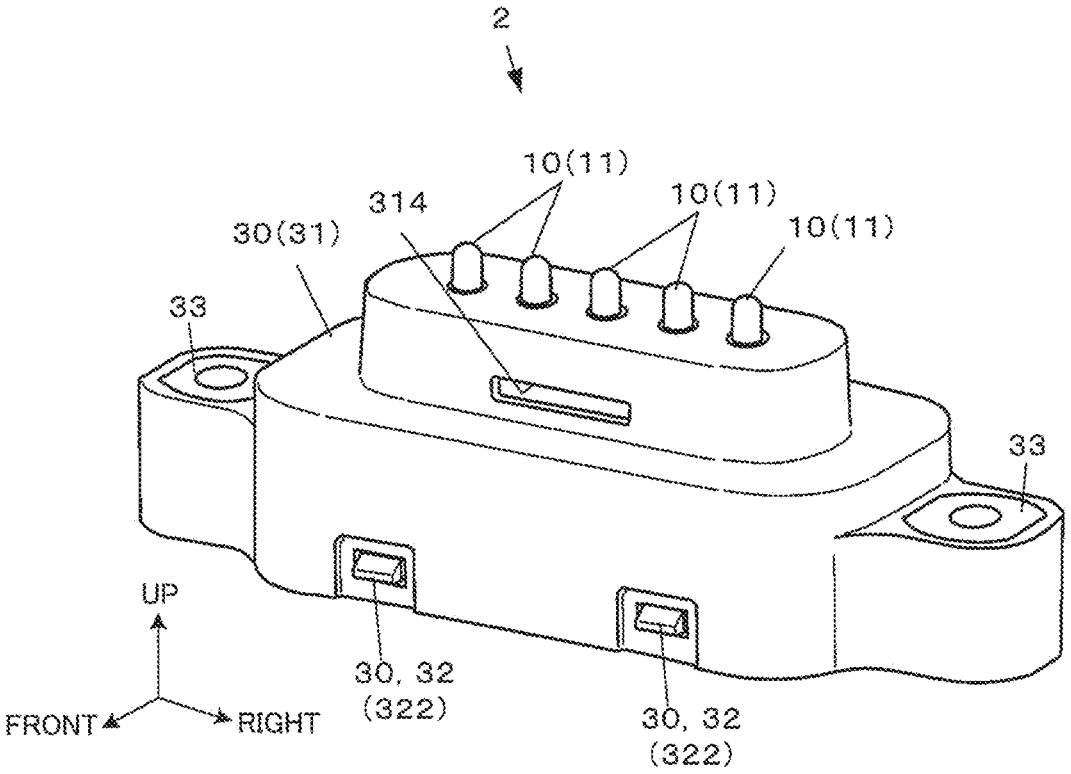
FIG. 1 is an external perspective view illustrating a structure of a spring-loaded connector.

A description will be given of example embodiments, but modes to which the invention is applicable are, as a matter of course, not limited to the following embodiments. Vertical and left-right directions regarding a spring-loaded connector are according to the directions of arrows indicated in the drawings. Left and right are directions in a view from a forward side (a front side).

First Embodiment

FIG. 1 is an external perspective view illustrating a structure of a spring-loaded connector according to a first embodiment.

Figure 2:
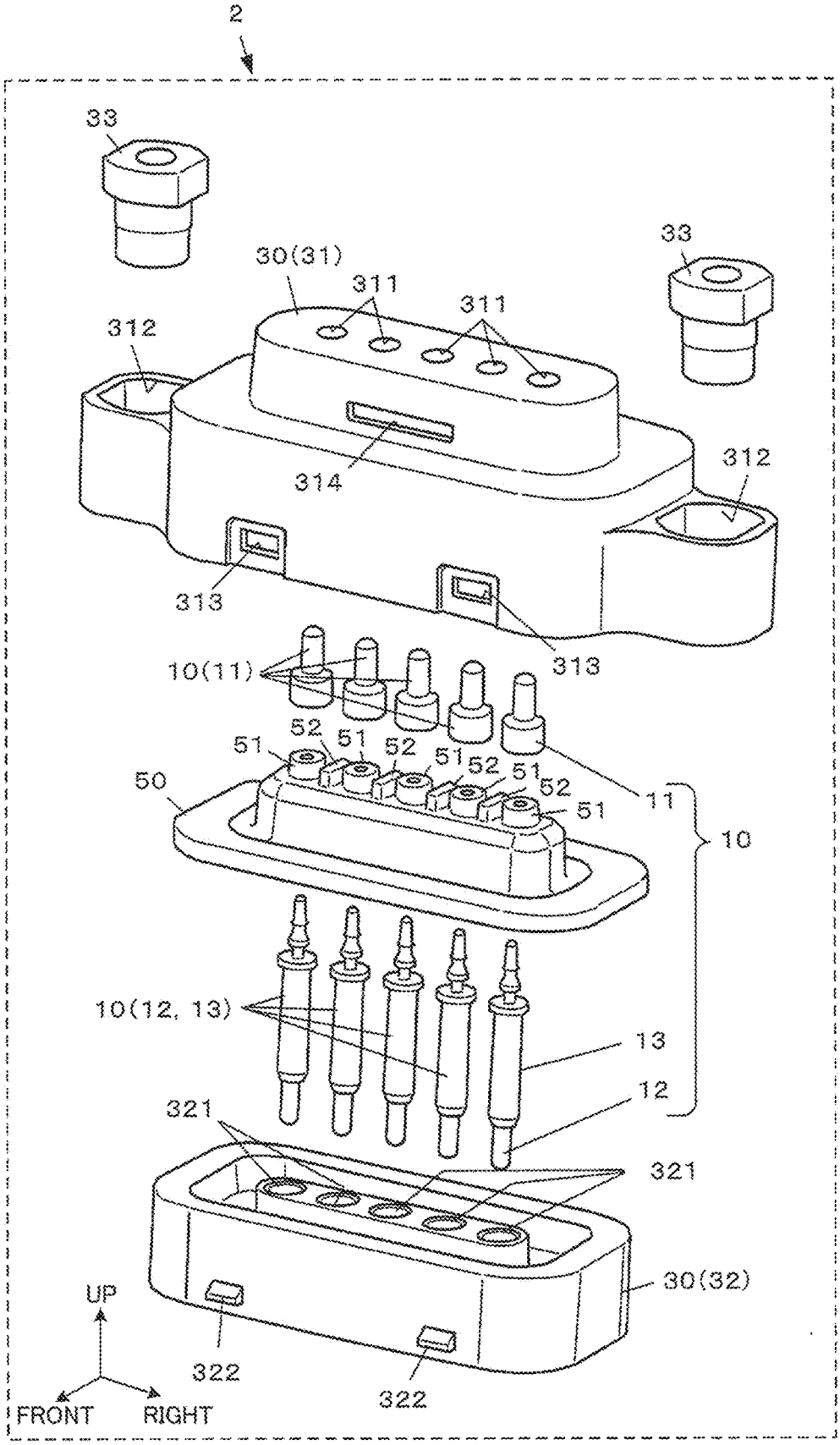
FIG. 2 is an exploded view illustrating the structure of the spring-loaded connector.

FIG. 2 is an exploded view illustrating the structure of the spring-loaded connector according to the first embodiment.

Figure 3:
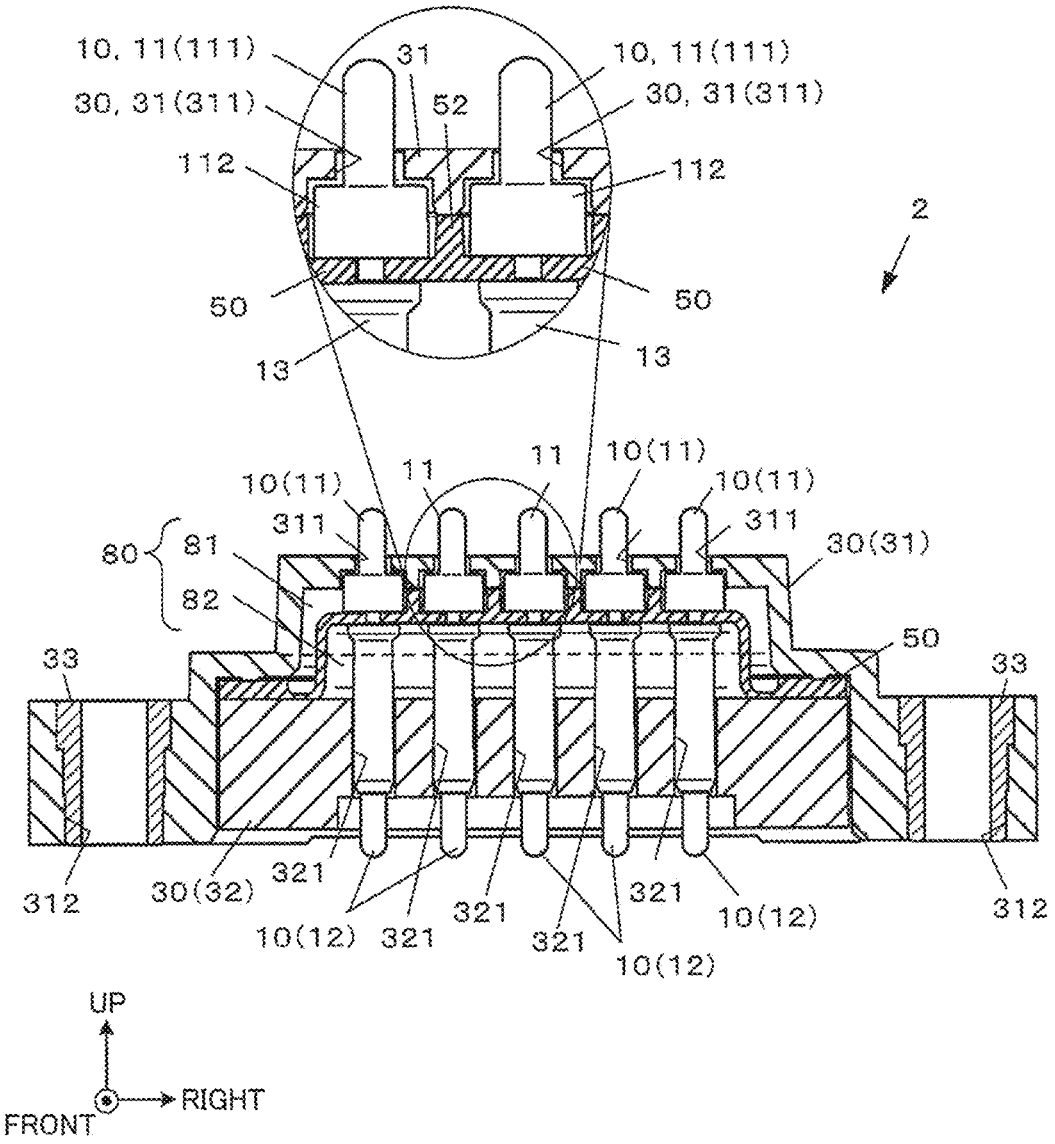
FIG. 3 is a vertical cross-sectional view of an assembled state along an arrangement direction of contact units.

FIG. 3 is a cross-sectional view illustrating an example structure of the spring-loaded connector according to the first embodiment, FIG. 3 being a vertical cross-sectional view of an assembled state along an arrangement direction of contact units.

Figure 4:
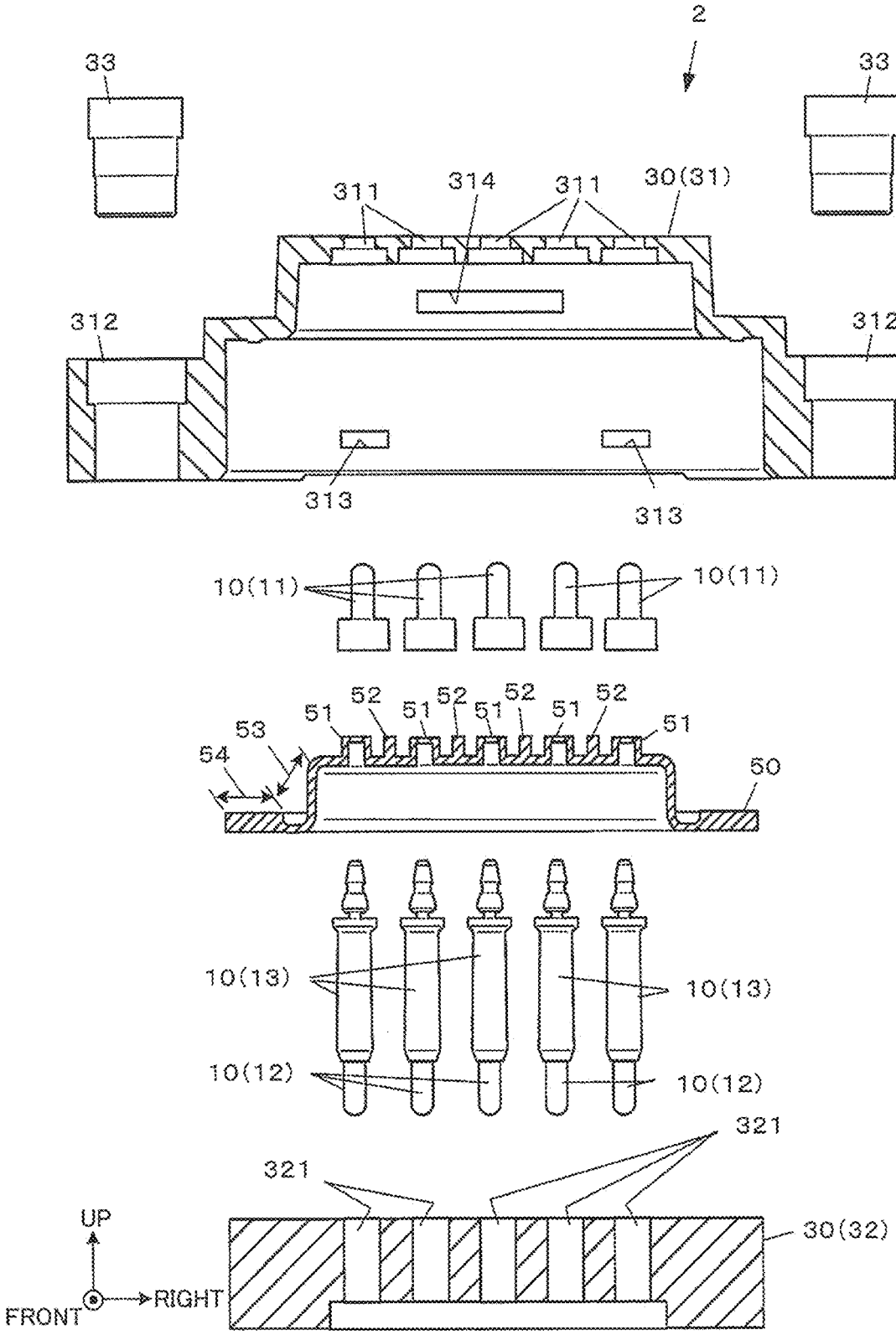
FIG. 4 is a vertical cross-sectional view of an exploded state along the arrangement direction of the contact units.

FIG. 4 is cross-sectional view illustrating an example structure of the spring-loaded connector according to the first embodiment, FIG. 4 being a vertical cross-sectional view of an exploded state along the arrangement direction of the contact units.

As illustrated in FIGS. 1 to 4, a spring-loaded connector 2 according to the first embodiment includes a plurality of contact units 10 that are arranged in a predetermined arrangement pattern, a case 30 that supports the contact units 10, and a waterproof elastic member 50 that is disposed inside the case 30.

With the spring-loaded connector 2 of the present embodiment, five contact units 10 are included and the arrangement pattern thereof is one row in the left-right direction, but the number of contact units 10 to be mounted and the arrangement pattern thereof are not limited to those in the present embodiment.

Figure 5A:
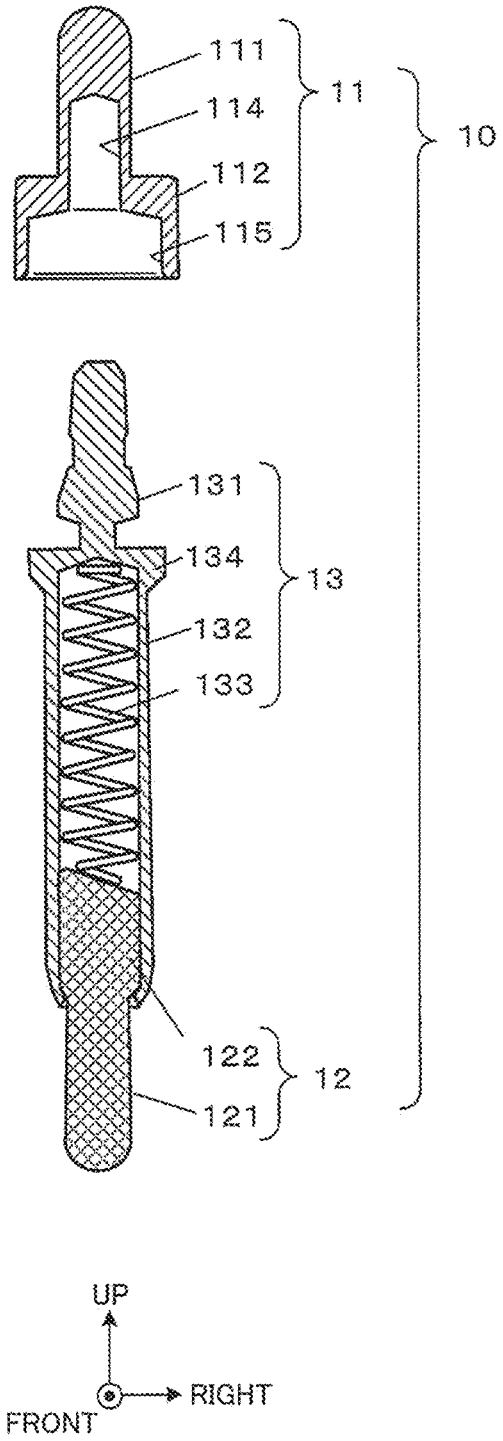
FIG. 5A is a vertical cross-sectional view illustrating an example structure of the contact unit cut along an extension direction, FIG. 5A being a cross-sectional view of a sub-assembly state.
Figure 5B:
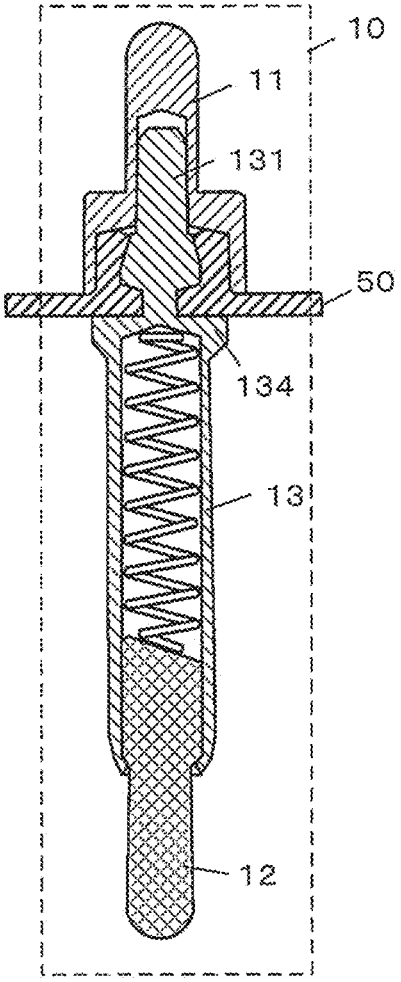
FIG. 5B is a vertical cross-sectional view illustrating an example structure of the contact unit cut along the extension direction, FIG. 5B being a cross-sectional view of an assembled state.
Figure 5B:
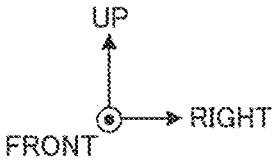

FIG. 5A is a vertical cross-sectional view illustrating an example structure of the contact unit 10 cut along an extension direction, FIG. 5A being a cross-sectional view of a sub-assembly state. FIG. 5B is a vertical cross-sectional view illustrating an example structure of the contact unit 10 cut along the extension direction, FIG. 5B being a cross-sectional view of an assembled state.

The contact unit 10 includes a first pin 11 for contacting a first connection target, a second pin 12 for contacting a second connection target, and an intermediate member 13 for biasing the first pin 11 and the second pin 12 in directions away from each other.

The first pin 11 is made of conductive material (such as copper or copper alloy, for example), and is a contact part that is to contact an electrode of a first electronic device as the first connection target (types of such devices include, but are not limited to, a smartphone, a mobile phone and an IC recorder, for example). The first pin 11 includes, in the following order from the top, a protruding small-diameter part 111, and a large-diameter part 112 that is connected to a lower end portion of the small-diameter part 111. A small-diameter hole 114 is formed inside the small-diameter part 111 by denting, the small-diameter hole 114 being concentric with the protrusion of the small-diameter part 111, and a concentric large-diameter hole 115 is further formed by denting, the large-diameter hole 115 being continuous to a lower end of the small-diameter hole 114.

The small-diameter part 111 and the large-diameter part 112 are joined by a step, and an upper surface of the large-diameter part 112 is a step surface that contacts an inner surface of the case 30 to prevent the first pin 11 from penetrating upward.

The small-diameter hole 114 is used to couple the first pin 11 and the intermediate member 13.

The second pin 12 is made of conductive material (such as copper or copper alloy, for example), and includes, in the following order from the bottom, a small-diameter part 121 and a large-diameter part 122.

The small-diameter part 121 is a contact part that is to contact an electrode of a second electronic device as the second connection target (types of such devices include, but are not limited to, a charging cradle for the first electronic device and a device that is electrically connected to the first electronic device to perform communication, for example).

The large-diameter part 122 is a part that is loosely fitted in the intermediate member 13.

The intermediate member 13 includes, in the following order from the top, a bar-shaped part 131, a cylindrical part 132, and a spring 133 that is held inside the cylindrical part 132. The bar-shaped part 131 and the cylindrical part 132 are made of conductive material (such as copper or copper alloy, for example), and are integrally molded. The spring 133 is a coil spring made from a piano wire or a stainless steel wire, for example.

The bar-shaped part 131 is a part that is to be pressed into the small-diameter hole 114 of the first pin 11. With respect to an assembly order, the bar-shaped part 131 is pressed into a cylindrical part 51 of the waterproof elastic member 50, and then, the bar-shaped part 131 and the cylindrical part 51 are pressed into the first pin 11. The bar-shaped part 131 and the cylindrical part 51 are thus pressed into the large-diameter hole 115 of the first pin 11, and a tip portion of the bar-shaped part 131 is pressed into the small-diameter hole 114 of the first pin 11.

A flange part 134 extends from an upper edge of the cylindrical part 132. At the time of holding the waterproof elastic member 50 with the first pin 11 and the flange part134, the flange part 134 supports the waterproof elastic member 50 by being pushed against a lower surface of the waterproof elastic member 50.

The contact unit 10 is sub-assembled into a state in FIG. 5A by assembly of the intermediate member 13 and assembling together of the second pin 12 and the intermediate member 13. Specifically, sub-assembly is performed by (1) inserting the spring 133 into the cylindrical part 132, (2) inserting the large-diameter part 122 of the second pin 12 into the cylindrical part 132, and (3) crimping an opening end of the cylindrical part 132 to retain the second pin 12, to thereby prepare for assembly of the spring-loaded connector 2.

When sub-assembled, the second pin 12 is biased downward by the spring 133 in a state where the second pin 12 is slidable inside the cylindrical part 132. The second pin 12 is placed in a state where the second pin 12 is allowed to protrude from or be accommodated inside the cylindrical part 132 of the intermediate member 13, and where the second pin 12 is electrically connected to the cylindrical part 132.

As illustrated in FIG. 3, the case 30 includes a cover 31 and a housing 32 made of insulating resin, and bushings 33 made of metal. The case 30 defines an inner space 80 when the cover 31 is assembled with the housing 32 from above. The contact unit 10 is supported by the case 30 in a manner penetrating the inner space 80.

An accommodation space that is stepped and that is open at a bottom is formed by the cover 31. The housing 32 may be accommodated in the accommodation space. Through holes 311 where the first pins 11 can be inserted such that tips of the first pins 11 are exposed above the case 30 are formed in a top part of the accommodation space.

Press-in holes 312 for the bushings 33 extend through left and right outer edges of the cover 31. The bushing 33 is used for insertion of a screw or the like for attachment, at the time of attaching the spring-loaded connector 2 to the second connection target. The bushing 33 may be insert-molded at the time of manufacturing the cover 31.

A communication hole 314 is formed in a front surface and a back surface of the cover 31, at parts above a step (see FIGS. 1 and 2), and an engaging hole 313 is formed in the front surface and the back surface, at parts below the step. The engaging hole 313 is engaged with an engaging claw 322 of the housing 32 at the time of assembling with the housing 32.

Lengths of a left-right width and a front-rear width of the housing 32 are such that the housing 32 has a size that can be inserted into an opening of the cover 31 from below. A height, that is, a length in the vertical direction, of the housing 32 is slightly smaller than a stepped part of the accommodation space of the cover 31. When the housing 32 is inserted in the cover 31, the inner space 80 is defined between an upper surface of the housing 32 and a top of the cover 31 (see FIG. 3).

The housing 32 includes through holes 321 along the vertical direction, from which tips of the second pins 12 are exposed. The through holes 321 are formed at positions where, when the cover 31 and the housing 32 are assembled together, the through holes 321 correspond to the through holes 311 of the cover 31 in a one-to-one manner, with the corresponding holes being concentric in the vertical direction.

The housing 32 includes, on a front surface and a back surface, the engaging claws 322 that are engaged with the engaging holes 313 of the cover 31 at the time of being assembled with the cover 31. Positions where the engaging claws 322 are formed may be other positions, such as on left and right side surfaces, as long as the engaging claws 322 can be engaged with the engaging holes 313.

Figure 6:
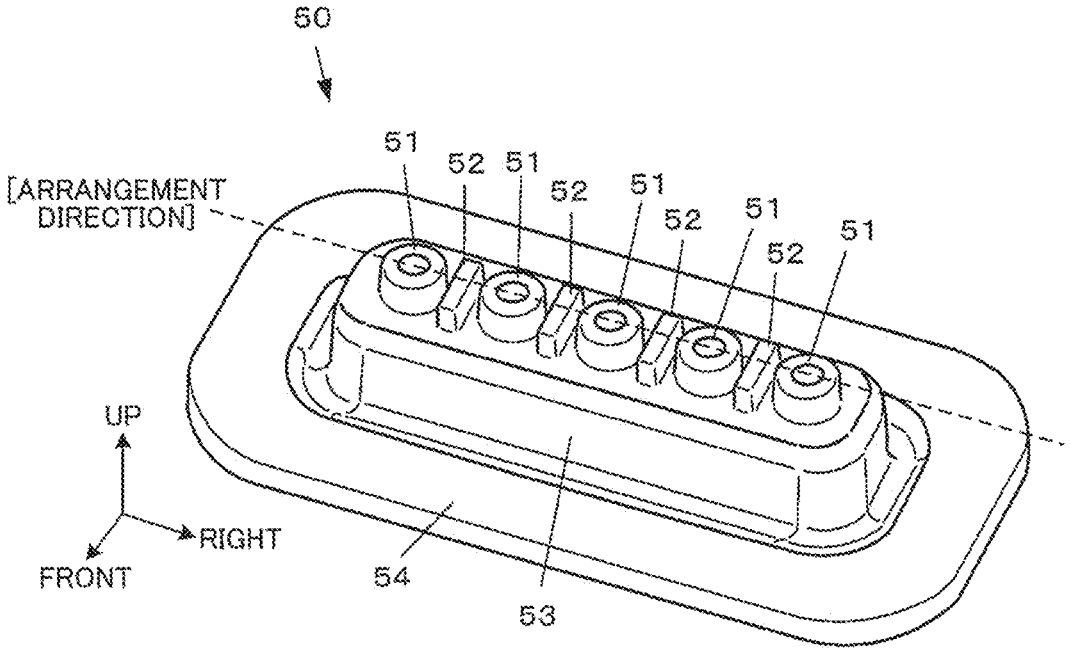
FIG. 6 is an external perspective view illustrating an example structure of a waterproof elastic member.

FIG. 6 is an external perspective view illustrating an example structure of the waterproof elastic member 50.

The waterproof elastic member 50 is a water-impervious, non-conductive member that separates the inner space 80 that is defined between the cover 31 and the housing 32 into a first section 81 on the side of the first pin 11 and a second section 82 on the side of the second pin 12 (see FIG. 3). The waterproof elastic member 50 is made of elastic material such as silicone rubber, for example.

The waterproof elastic member 50 has a box shape that is open at a bottom and that is like a bathtub that is turned upside down. Specifically, the cylindrical parts 51 and water-shielding structures 52 are formed on an upper surface of the waterproof elastic member 50. A sloping part 53 that slopes downward is formed from an entire circumferential portion of the upper surface, and a skirt part 54 extends from a lower edge of the sloping part 53 in the shape of a flange.

The number of cylindrical parts 51 is the same as the number of contact units 10 so that the cylindrical parts 51 correspond to the contact units 10 in a one-to-one manner, and the cylindrical parts 51 each protrude toward the through hole 311 of the cover 31. The cylindrical parts 51 are each held between the first pin 11 and the intermediate member 13 of the corresponding contact unit 10 to be interposed between an inner side of the first pin 11 and an outer side of the intermediate member 13, and the first pin 11 and the intermediate member 13 are thus sealed in a watertight manner (see FIG. 5B).

The water-shielding structure 52 is disposed between the cylindrical parts 51 that are adjacent to each other. Specifically, the water-shielding structure 52 is designed as a wall-shaped protrusion, and is designed to have a length in an intersecting direction intersecting an arrangement direction of the adjacent cylindrical parts 51 (the same as the arrangement direction of the contact units 10) that is, in a bird's-eye view along a protruding direction (that is, when looking down on the spring-loaded connector 2 from directly above), equal to or greater than an outer dimension of the cylindrical parts 51 in the intersecting direction. When describing with reference to FIG. 6, a length of the water-shielding structure 52 in a front-rear direction is equal to or greater than a length of the cylindrical part 51 in the front-rear direction. A height of the water-shielding structure 52 is set such that an upper end contacts an inner side of the cover 31 in a state where the first pin 11 is not in contact with the first connection target (see a partial enlarged view in FIG. 3). Alternatively, the height of the water-shielding structure 52 may be such that the upper end does not contact the inner side of the cover 31 in the state where the first pin 11 is not in contact with the first connection target.

The skirt part 54 functions as a watertight packing between the cover 31 and the housing 32 by being held between the two at the time of the cover 31 and the housing 32 being assembled together.

Now, a flow of assembly of the spring-loaded connector 2 will be described.

As described above, first, the second pin 12 and the intermediate member 13 of the contact unit 10 are sub-assembled (see FIG. 5A).

Next, the contact unit 10 is assembled to sandwich the waterproof elastic member 50, and the two are sub-assembled (see FIG. 5B). Specifically, the bar-shaped part 131 of the sub-assembled contact unit 10 is inserted through the cylindrical part 51 of the waterproof elastic member 50. At this time, an insertion direction is according to a protruding direction of the cylindrical part 51. Then, the bar-shaped part 131 protruding from the cylindrical part 51 is pressed into the small-diameter hole 114 and the large-diameter hole 115 of the first pin 11. The cylindrical part 51 is thereby elastically deformed to fill between the large-diameter hole 115 and the bar-shaped part 131 of the first pin 11, and is sandwiched between the large-diameter hole 115 and the bar-shaped part 131 of the first pin 11 in a watertight manner. In the present embodiment, five contact units 10 are used, and the five pieces are assembled together in the same manner.

Next, the contact unit 10 and the waterproof elastic member 50 that are sub-assembled are placed over the housing. At this time, the second pin 12 of each contact unit 10 is inserted in the through hole 321 of the housing 32. The skirt part 54 of the waterproof elastic member 50 is placed in a state where the skirt part 54 is on an outer circumferential portion of the housing 32.

Next, the housing 32 where the contact units 10 are inserted is placed below and pushed into the cover 31 to be accommodated. At this time, the first pins 11 of the contact units 10 are inserted and pushed into the through holes 311 of the cover 31. In the process of pushing-in, the skirt part 54 of the waterproof elastic member 50 is held between a lower surface of the stepped part of the accommodation space of the cover 31 and an upper surface of the outer circumferential portion of the housing 32. When pushing-in is performed to a sufficient degree, the engaging claws 322 of the housing 32 are fitted in the engaging holes 313 of the cover 31, and the cover 31, the housing 32, and the waterproof elastic member 50 are fixed to one another. Assembly of the spring-loaded connector 2 is thus completed.

Effects of the water-shielding structure 52 will be described.

In a non-contact state where the first pins 11 are not in contact with the first electronic device as the first connection target, the spring-loaded connector 2 is in the state as illustrated in FIG. 3. There is a slight gap between the first pins 11 and the through holes 311 of the cover 31, and thus, water possibly enters through the gap from outside.

Figure 7:
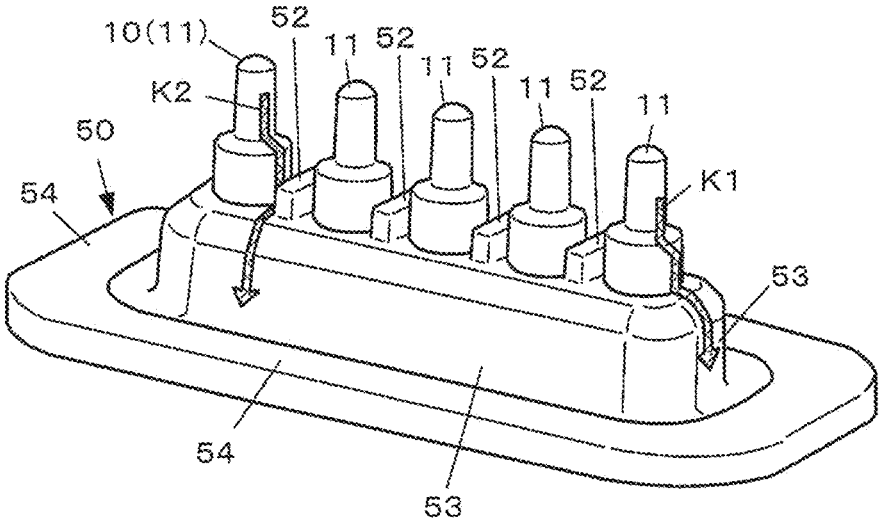
FIG. 7 is a conceptual view illustrating a possible flow route of water entering along a first pin.

FIG. 7 is a conceptual view illustrating a possible flow route of water entering along the first pin 11. As indicated by an example route K1, water flowing along the first pin 11 and entering between the first pin 11 and the through hole 311 of the cover 31 basically flows down an outer surface of the first pin 11, and flows further down the sloping part 53 of the waterproof elastic member 50 to reach a periphery of the skirt part 54.

With a related art spring-loaded connector not including the water-shielding structures 52, if the route along the first pin 11 extends between the contact units 10 that are adjacent to each other, as indicated by an example route K2, the water will possibly remain between the adjacent contact units 10. Particularly, if the gap between the contact units 10 that are adjacent to each other is small, water tends to exhibit viscosity, and water adhering in a manner joining the adjacent contact units 10 may remain as it is to cause electrical shorting.

If an arrangement gap that is sufficient relative to the amount of entering water is secured between the contact units 10, shorting is not caused by water even if water reaches between the contact units 10. However, to reduce the size of the spring-loaded connector 2, the arrangement gap between the contact units 10 is desired to be reduced as much as possible. The smaller the arrangement gap between the contact units 10, the more likely the first pins 11 of the adjacent contact units 10 are to be electrically connected and shorted by presence of water between the first pins even if the amount of entering water is quite small.

However, with the spring-loaded connector 2 of the present embodiment, the wall-shaped water-shielding structure 52 is present between the contact units 10 that are adjacent to each other. Accordingly, water entering along the example route K2 is guided to the sloping part 53 to flow down the sloping part 53, and flows down to the periphery of the skirt part 54. The entering water will not stay between the adjacent contact units 10, and the adjacent contact units 10 are not electrically connected to each other.

Water flowing down the sloping part 53 to the periphery of the skirt part 54 temporarily remains at a position away from the first pins 11, but discharge of water through the communication hole 314 is facilitated by attachment/detachment of the first electronic device as the first connection target and the second electronic device as the second connection target, and the possibility of occurrence of shorting caused by water is reduced.

Facilitation of water discharge through the communication hole 314 will be described.

Figure 8:
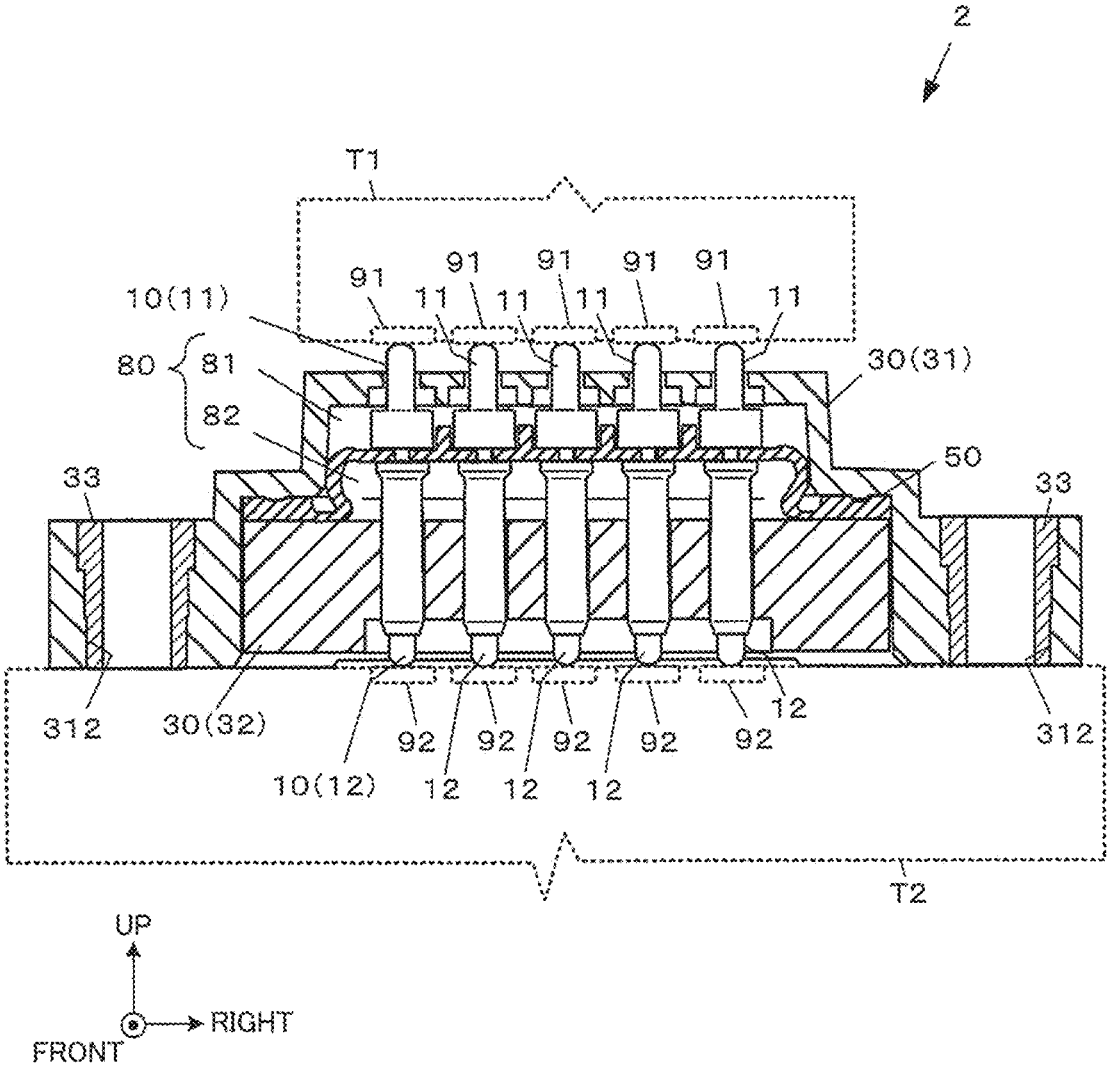
FIG. 8 is a vertical cross-sectional view of a contact state where a first electronic device as a first connection target is mounted on a second electronic device as a second connection target, and a first pin 11 is in contact with a terminal of the first connection target.

FIG. 8 is a vertical cross-sectional view of a contact state where the first electronic device as the first connection target (such as a smartphone) is mounted on the second electronic device as the second connection target (such as a charging cradle), and the first pin 11 is in contact with a terminal of the first connection target.

Now, a section volume of the first section 81 of the inner space 80 will be focused on. In a connection state where the first pins 11 are abutted against electrodes 91 of a first electronic device T1 as the first connection target, the waterproof elastic member 50 is elastically deformed. As a result, the section volume of the first section 81 is greater than the section volume in a non-contact state (see FIG. 3) where the first pins 11 are not in contact with the electrodes 91 of the first electronic device T1 as the first connection target.

The communication holes 314 are formed in the cover 31. The communication holes 314 are each formed at a position facing the sloping part 53 of the waterproof elastic member 50, with a lower end of the communication hole 314 being close to an upper surface of the skirt part 54 (see FIG. 4). The communication holes 314 are holes through which the first section 81 communicates with the outside at positions close to the skirt part 54 of the waterproof elastic member 50. Accordingly, when the connection state where the first pins 11 are abutted against the electrodes 91 of the first electronic device T1 as the first connection target is reached, outside air flows into the case 30 through the communication holes 314 by the amount that the section volume of the first section 81 is increased.

When connection between the first electronic device T1 as the first connection target and the second electronic device T2 as the second connection target is released, the section volume of the first section 81 is returned to the volume in the non-contact state. At this time, air is pushed out and discharged from inside the case 30 to outside by the amount of air that previously flowed in through the communication holes 314. The flow of air being discharged, or a force of the waterproof elastic member 50 returning to an original shape from the elastically deformed shape, acts to actively push out, through the communication holes 314, water that is retained around the skirt part 54 of the waterproof elastic member 50 after flowing down inside the case 30. Mutual effects between the communication holes 314 and the waterproof elastic member 50 achieve a function of a pseudo-pump that removes water from the first section 81.

When the amount of water that is retained near the skirt part 54 of the waterproof elastic member 50 after flowing down is increased and water reaches lower ends of the communication holes 314, or when the second electronic device T2 as the second connection target is tilted, water that is retained near the skirt part 54 after flowing down may be discharged through the communication holes 314 on its own.

As described above, with the spring-loaded connector 2 of the present embodiment, shorting between the contact units due to presence of water may be prevented, and both waterproofness and reduced size may be achieved.

MODIFICATIONS

Heretofore, an example embodiment where the invention is applied has been described, but a mode to which the invention can be applied is not limited to the mode described above, and structural elements may be added, omitted, or changed as appropriate.

First Modification

Figure 9:
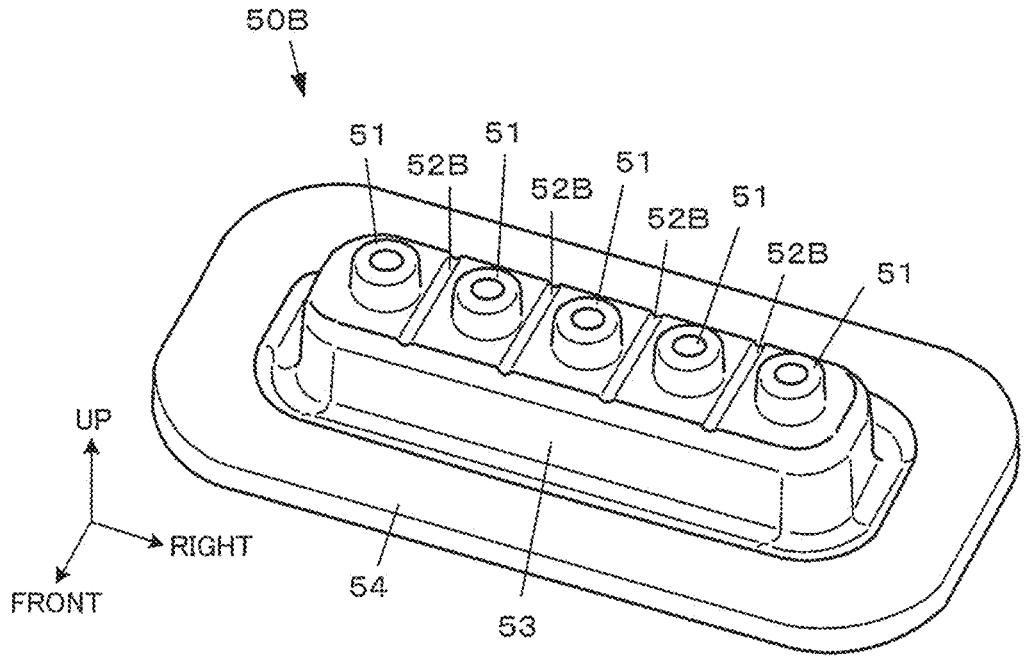
FIG. 9 is a perspective view of a waterproof elastic member according to a first modification.

For example, the above-described embodiment describes an example where the water-shielding structure 52 is realized as a protrusion, but as illustrated in FIG. 9, a water-shielding structure 52B of a waterproof elastic member 50B that is realized as a groove is also possible.

Second Modification

Figure 10:
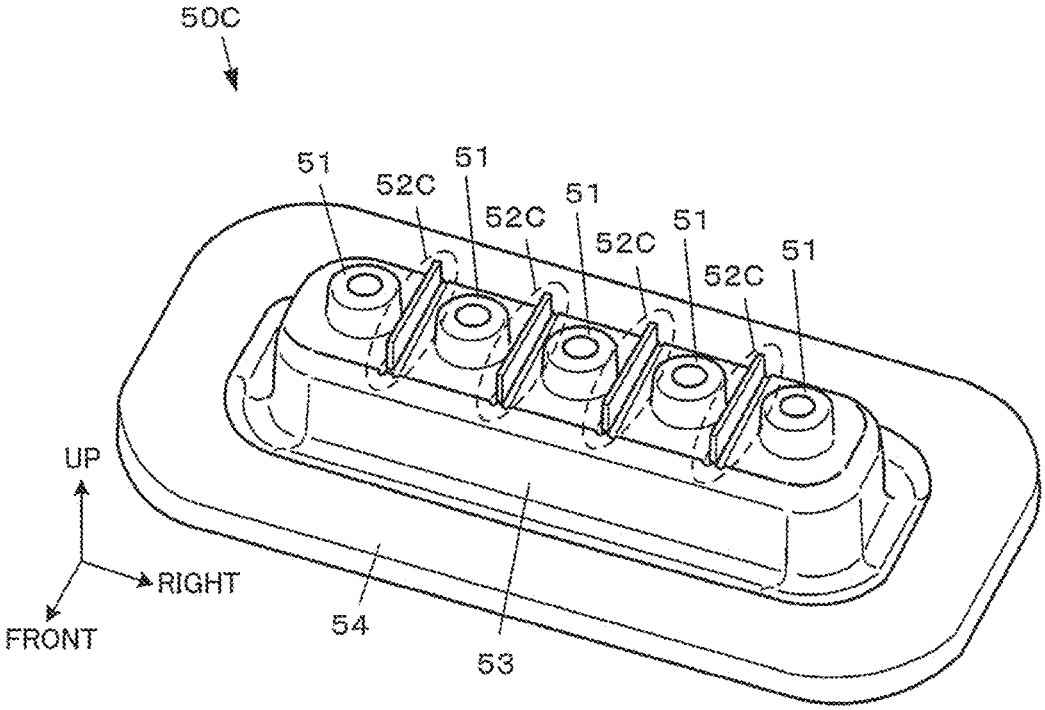
FIG. 10 is a perspective view of a waterproof elastic member according to a second modification.

As illustrated in FIG. 10, a water-shielding structure 52C of a waterproof elastic member 50C that is realized using both a protrusion and a groove is also possible.

Third Modification

Figure 11:
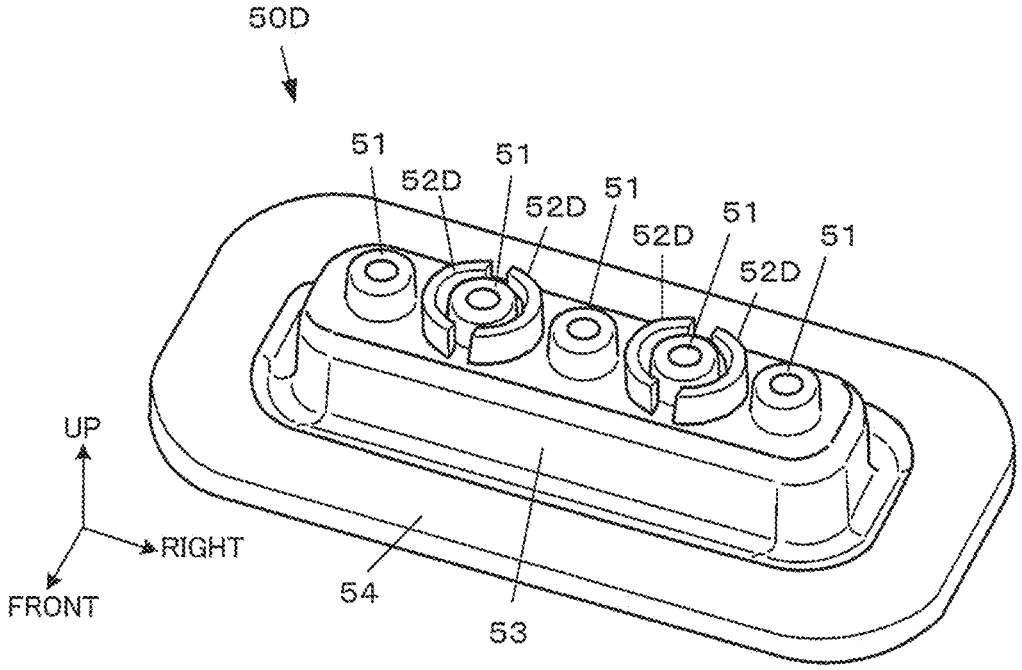
FIG. 11 is a perspective view of a waterproof elastic member according to a third modification.

The water-shielding structure 52 may be designed to be curved without being limited to be a straight wall or groove. For example, as illustrated in FIG. 11, a water-shielding structure 52D may be designed as an arc-shaped protrusion, and one of the contact units 10 that are adjacent to each other may be surrounded by arcs by the water-shielding structures 52D. Also in this case, the water-shielding structure 52D is disposed between the cylindrical parts 51 that are adjacent to each other. The water-shielding structure 52D may be a groove, instead of a protrusion. Alternatively, a groove may run along an outer circumference of the water-shielding structure 52D, and one water-shielding structure 52D may include both a protrusion and a groove.

Fourth Modification

The above-described embodiment describes the contact units 10 to be arranged in one straight row, but the arrangement pattern may be changed as appropriate, and the shape of the water-shielding structure 52 may be set to shapes other than those in the above-described modifications as appropriate depending on the arrangement pattern.

Figure 12:
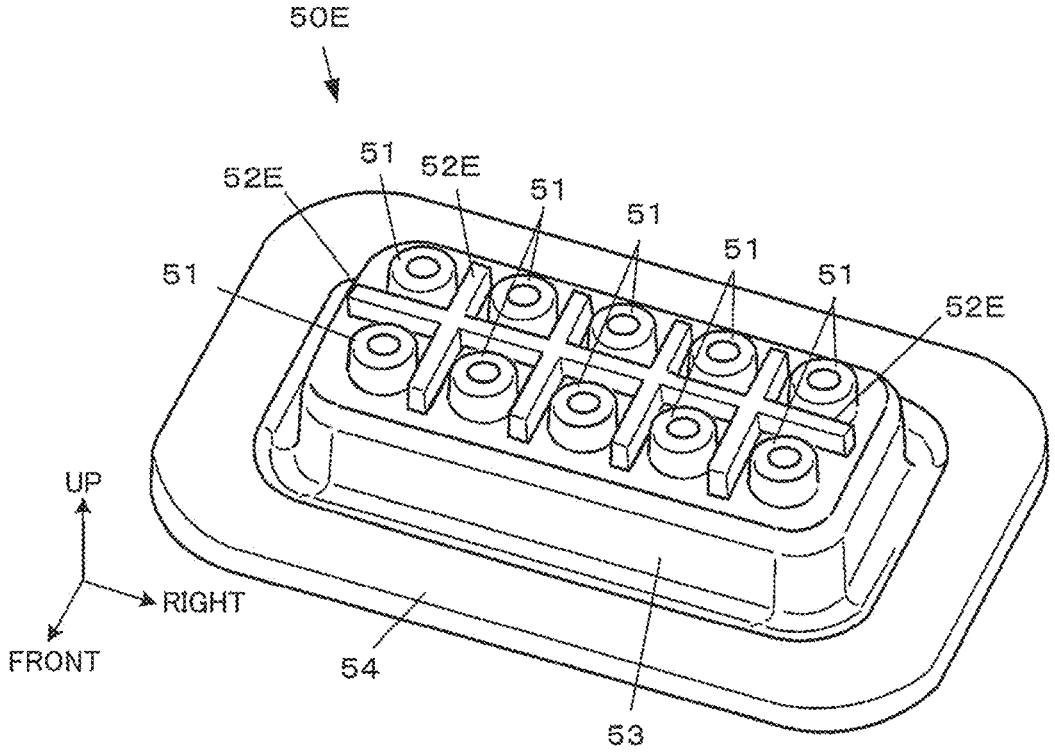
FIG. 12 is a perspective view of a waterproof elastic member according to a fourth modification.

For example, in the case of adopting an arrangement pattern where the contact units 10 are lined up in two rows, five in each row, as in the case of a waterproof elastic member 50E illustrated in FIG. 12, a water-shielding structure 52E may be disposed not only between the contact units 10 that are adjacent to each other in the left-right direction, but also between the contact units 10 that are adjacent to each other in the front-rear direction. The water-shielding structure 52E may be a groove, instead of a protrusion as illustrated in FIG. 12.

Fifth Modification

Figure 13:
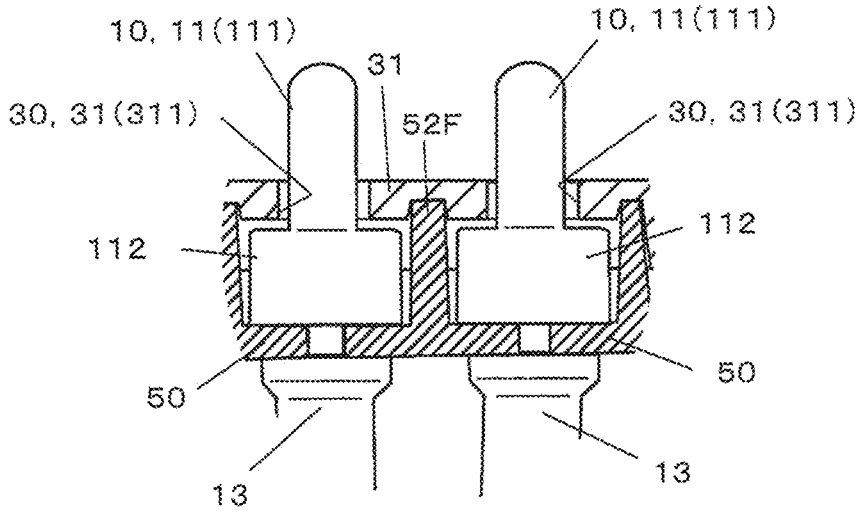
FIG. 13 is an enlarged cross-sectional view for describing a modification regarding height setting for a case where a water-shielding structure is realized as a protrusion.

The above-described embodiment describes an example where, when the water-shielding structure 52 is realized as a protrusion, the height is set such that the water-shielding structure 52 contacts an inner surface of a top of the case 30. In this case, as illustrated in the partial enlarged view in FIG. 3, the water-shielding structure 52 is in contact with the inner side of the cover 31 at a part below the step between the small-diameter part 111 and the large-diameter part 112 of the first pin 11. However, the position in a height direction at which the water-shielding structure 52 and the inner side of the cover 31 are to contact is not limited to such a position. For example, as illustrated in FIG. 13, the water-shielding structure 52 may be set to contact the inner side of the cover 31 at a part above the step between the small-diameter part 111 and the large-diameter part 112 of the first pin 11.

EXPLANATION OF REFERENCES

2 spring-loaded connector
10 contact unit
11 first pin
12 second pin
13 intermediate member
30 case
31 cover
32 housing
50 waterproof elastic member
51 cylindrical part
52 (52B, 52C, 52D, 52E, 52F) water-shielding structure
53 sloping part
54 skirt part
80 inner space
81 first section
82 second section
311 through hole
314 communication hole
T1 first electronic device
T2 second electronic device

The invention claimed is:

1. A spring-loaded connector comprising:

contact units each including a first pin for contacting a first connection target, a second pin for contacting a second connection target, and an intermediate member for biasing the first pin and the second pin in directions away from each other:

a case including a cover including a through hole where a tip of the first pin is exposed, and a housing including a through hole where a tip of the second pin is exposed, the case being for supporting the contact units; and a waterproof elastic member including cylindrical parts corresponding to the contact units, respectively, a cylindrical part among the cylindrical parts sealing between the first pin and the intermediate member of a contact unit corresponding to the cylindrical part, among the contact units, in a watertight manner by being interposed between an inner side of the first pin and an outer side of the intermediate member, wherein the waterproof elastic member integrally forms, between the cylindrical parts that are adjacent to each other, a water-shielding structure which is a non-circular wall-shaped protrusion for preventing the first pins of the contact units corresponding to the cylindrical parts that are adjacent to each other from being electrically connected due to presence of water between the first pins.

2. The spring-loaded connector according to claim 1, wherein a length of the water-shielding structure in an intersecting direction is equal to or greater than an outer dimension of the cylindrical parts in the intersecting direction, the intersecting direction intersecting an arrangement direction of the cylindrical parts that are adjacent to each other.

3. The spring-loaded connector according to claim 1, wherein an upper end of the protrusion contacts an inner side of the cover in a state where the first pin is not in contact with the first connection target.

4. The spring-loaded connector according to claim 1, wherein the water-shielding structure includes a groove.

5. The spring-loaded connector according to claim 1, wherein the case supports the contact units in such a way that the contact units penetrate an inner space defined between the cover and the housing, and the waterproof elastic member separates the inner space into a first section on a side of the first pin and a second section on a side of the second pin by being disposed between the cover and the housing.

6. The spring-loaded connector according to claim 5, wherein the waterproof elastic member is elastically deformed when the first pin is abutted against the first connection target, and a section volume of the first section is greater in a connection state where the first pin is abutted against the first connection target than in a non-contact state where the first pin is not in contact with the first connection target.

7. The spring-loaded connector according to claim 5, wherein the cover includes a communication hole through which outside and the first section communicate.

8. The spring-loaded connector according to claim 7, wherein the waterproof elastic member is elastically deformed when the first pin is abutted against the first connection target, a section volume of the first section is greater in a connection state where the first pin is abutted against the first connection target than in a non-contact state where the first pin is not in contact with the first connection target, and the communication hole is a passage that is used when water entering the first section is to be discharged to the outside at a time of state transition from the connection state to the non-contact state.

9. The spring-loaded connector according to claim 8, wherein the waterproof elastic member includes the cylindrical parts each having a shape protruding toward the through hole of the cover, a skirt part sandwiched between the cover and the housing, and a sloping part between the cylindrical parts and the skirt part, the entering water flows down the sloping part to reach the skirt part, and the communication hole is formed at a position facing the sloping part.

10. The spring-loaded connector according to claim 9, wherein air of the outside flows in through the communication hole when the connection state is reached, and the air that flowed in is discharged through the communication hole at a time of state transition to the non-contact state.

11. The spring-loaded connector according to claim 9, wherein the communication hole is formed at a position at which a lower end of the communication hole is close to an upper surface of the skirt part.

12. A spring-loaded connector comprising:

contact units each including a first pin for contacting a first connection target, a second pin for contacting a second connection target, and an intermediate member for biasing the first pin and the second pin in directions away from each other;

a case including a cover including a through hole where a tip of the first pin is exposed, and a housing including a through hole where a tip of the second pin is exposed, the case being for supporting the contact units; and a waterproof elastic member including cylindrical parts corresponding to the contact units, respectively, the waterproof elastic member being disposed between the cover and the housing, a cylindrical part among the cylindrical parts sealing between the first pin and the intermediate member of a contact unit corresponding to the cylindrical part, among the contact units, in a watertight manner by being interposed between an inner side of the first pin and an outer side of the intermediate member, wherein the waterproof elastic member includes, between the cylindrical parts that are adjacent to each other, a water-shielding structure including a non-circular wall-shaped protrusion, a length of which in an intersecting direction being equal to or greater than an outer dimension of the cylindrical parts in the intersecting direction, the intersecting direction intersecting an arrangement direction of the cylindrical parts that are adjacent to each other.

13. The spring-loaded connector according to claim 12, wherein the water-shielding structure includes a groove.

14. The spring-loaded connector according to claim 12, wherein the case supports the contact units in such a way that the contact units penetrate an inner space defined between the cover and the housing, and the waterproof elastic member separates the inner space into a first section on a side of the first pin and a second section on a side of the second pin by being disposed between the cover and the housing.

15. The spring-loaded connector according to claim 12, wherein an upper end of the protrusion contacts an inner side of the cover in a state where the first pin is not in contact with the first connection target.

16. A spring-loaded connector comprising:

a contact unit including a first pin for contacting a first connection target, a second pin for contacting a second connection target, and an intermediate member for biasing the first pin and the second pin in directions away from each other;

a case including a cover including a through hole where a tip of the first pin is exposed, and a housing including a through hole where a tip of the second pin is exposed, the case being for supporting the contact unit; and a waterproof elastic member including a cylindrical part corresponding to the contact unit, the waterproof elastic member being disposed between the cover and the housing, the cylindrical part sealing between the first pin and the intermediate member of the contact unit corresponding to the cylindrical part in a watertight manner by being interposed between an inner side of the first pin and an outer side of the intermediate member, wherein the waterproof elastic member includes the cylindrical part having a shape protruding toward the through hole of the cover, a skirt part sandwiched between the cover and the housing, and a sloping part between the cylindrical part and the skirt part, the cover includes a communication hole formed at a position facing the sloping part, and the communication hole is fouled at a position at which a lower end of the communication hole is close to an upper surface of the skirt part.

17. The spring-loaded connector according to claim 16, wherein the case supports the contact unit in such a way that the contact unit penetrates an inner space defined between the cover and the housing, the waterproof elastic member separates the inner space into a first section on a side of the first pin and a second section on a side of the second pin by being disposed between the cover and the housing, and the communication hole allows outside and the first section to communicate.

18. The spring-loaded connector according to claim 17, wherein the waterproof elastic member is elastically deformed when the first pin is abutted against the first connection target, a section volume of the first section is greater in a connection state where the first pin is abutted against the first connection target than in a non-contact state where the first pin is not in contact with the first connection target, and the communication hole is a passage that is used when water entering the first section is to be discharged to the outside at a time of state transition from the connection state to the non-contact state.

19. The spring-loaded connector according to claim 18, wherein air of the outside flows in through the communication hole when the connection state is reached, and the air that flowed in is discharged through the communication hole at a time of state transition to the non-contact state.

* * * * *